United States Patent [19]

Huber

[11] 4,040,705

[45] Aug. 9, 1977

[54] COAXIAL RIBBON CABLE CONNECTOR

[75] Inventor: John Henry Huber, Harrisburg, Pa.

[73] Assignee: AMP Incorporated, Harrisburg, Pa.

[21] Appl. No.: 766,632

[22] Filed: Feb. 8, 1977

Related U.S. Application Data

[60] Continuation of Ser. No. 675,838, April 12, 1976, abandoned, which is a continuation of Ser. No. 564,501, April 2, 1975, abandoned, which is a division of Ser. No. 507,170, Sept. 18, 1974, Pat. No. 3,907,396, which is a division of Ser. No. 391,727, Aug. 27, 1973, Pat. No. 3,864,011.

[51] Int. Cl.[2] ..... H01R 13/38

[52] U.S. Cl. ..... 339/99 R

[58] Field of Search ..... 339/97–99, 339/176, 223, 258, 259, 260, 262

[56] References Cited

U.S. PATENT DOCUMENTS

| | | | |
|---|---|---|---|
| 2,468,368 | 4/1949 | Jackson | 339/258 P |
| 2,766,438 | 10/1956 | Kohler et al. | 339/258 T |

*Primary Examiner*—Joseph H. McGlynn
*Attorney, Agent, or Firm*—Allan B. Osborne

[57] ABSTRACT

This invention relates to a connector for multi-unit coaxial cable of the type wherein each center conductor has an individual shield and each shield has a separate drain wire. More particularly, the connector includes a plurality of contact members each of which consists of an opposing cantilever contact spring section for mating with contact elements of other electrical circuits, a dual in-line cantilever, torsion bar terminating section for receiving either the coaxial cable center conductor or the drain wire, a housing to hold the plurality of contact members and a strain relief clamp member.

1 Claim, 7 Drawing Figures

COAXIAL RIBBON CABLE CONNECTOR

This is a continuation of application Ser. No. 675,838, filed Apr. 12, 1976, now abandoned, which is in turn a continuation of application Ser. No. 564,501, filed Apr. 2, 1975 and now abandoned, which is in turn a divisional of application Ser. No. 507,170, filed Sept. 18, 1974, and now U.S. Pat. No. 3,907,396, which is in turn a divisional of application Ser. No. 391,727, filed Aug. 27, 1973, and now U.S. Pat. No. 3,864,011.

BACKGROUND OF THE INVENTION

Miniaturization, particularly in the electronic industry, created a need to pack in a large number of signal-carrying wire into small spaces. In order to avoid having a large number of individual wires coming into a device such as a printed circuit board, flat multi-conductor ribbon cable was developed. Further, in order to prevent the unintentional transfer of electrical signals; i.e., cross-talk, between cables and between individual conductors in a single cable, shielding was incorporated. Such shielding may take the form of a wrap of conducting material around the entire multi-conductor cable; see for example, U.S. Pat. No. 3,634,782. Or each individual conductor may be encased in a sheath of conducting material such as disclosed in U.S. Pat. No. 3,663,739. Although not insurmountable, many problems did develop in terminating the shielded multi-conductor flat cable, particularly in terminating the shielding material itself. These problems led one worker in the field to invent a multi-conductor cable wherein each center conductor is individually shielded and each shield is provided with a drain wire which is in parallel and in contact with the shielding. This invention is disclosed in U.S. Pat. No. 3,775,552, the contents thereof being incorporated herein by reference. The individual drain wires provided a first step toward simplified terminating of multi-conductor cable of a coaxial nature; i.e., coaxial ribbon cable. What remained to be done was to invent a connector which would accomplish the simplified termination.

Accordingly, the present invention provides a connector which consists of an insulated housing having cavities therein, each cavity adapted to receive a contact member of the type where one end contains an opposing cantilever spring contact section and the opposite end contains a dual in-line, cantilever, torsion bar wire terminating section.

BRIEF DESCRIPTION OF THE DRAWINGS

The invention, together with its construction and method of operation, along with other objects and advantages thereof, is illustrated more or less diagrammatically in the drawings, in which.

DESCRIPTION OF THE PREFERRED EMBODIMENT

Figure 1:
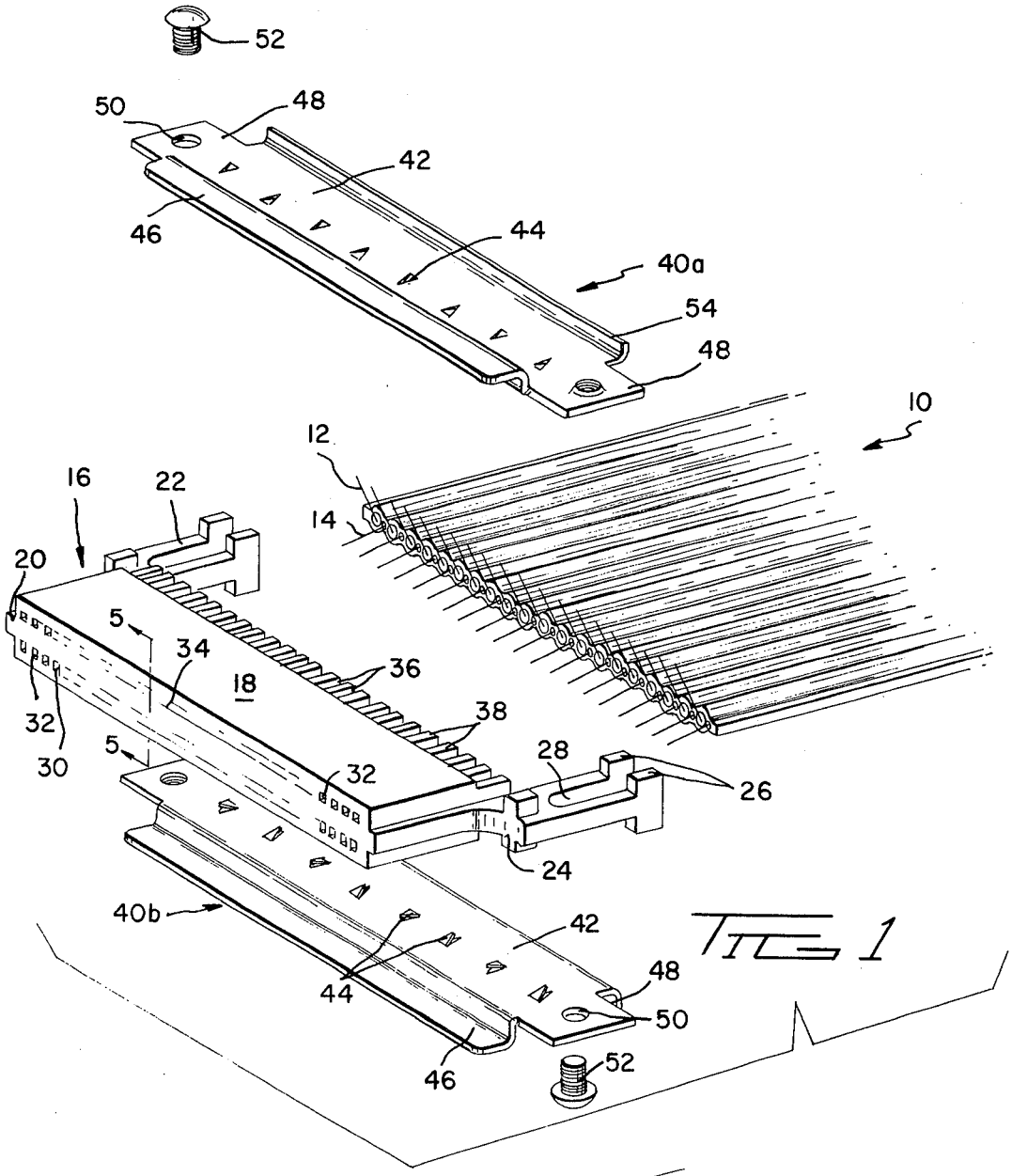
FIG. 1 is an exploded view of the housing member, strain relief clamp member and a prepared coaxial ribbon cable.

In FIG. 1 the coaxial ribbon cable 10 which is to be terminated to the connector constructed in accordance with the present invention consists of signal-carrying center conductors 12, drain wires 14 and suitable insulating material. This particular type coaxial ribbon cable is described in the aforementioned U.S. Pat. No. 3,775,552. Directly in front of cable 10 is housing member 16 which is molded from an insulating material such as glass-filled nylon. The external features of housing member 16 include the housing body 18 bounded on either side by rails 20 which, at one end, expand outwardly into mounting flanges 22. Each flange 22 has one forward lug 24, two rearward lugs 26 and a slot 28 all of which constitute in cooperation means for retaining cable strain relief clamps 40.

Internally housing body 18 contains two rows of cavities 30, one row above the other, with each cavity extending through the body. The internal structure of the cavities is described below. The external expressions of the cavities are contact element entrances 32, seen on the front face 34 of body 18, and the contact openings 36, the top row of which is seen running across the rear portion 38 of body 18. Each cavity is isolated physically and electrically from its horizontal and vertical neighbors. The contact openings 36 begin at the back edge 39 of the horizontal surface of body 18 (see FIG. 5).

The two halves *a* and *b* of the cable strain relief clamp 40 are shown, one above and the other below housing member 16. Each half contains a surface 42 in which a number of inwardly directed lances 44 are coined. These lances, pointing alternatively forwardly and rearwardly, bite into the outer insulation of cable 10 to provide the mechanical strain relief. Forwardly and displaced above surface 42 is lip 46 which covers a row of the contact openings 36 of the housing member when assembled.

On either side of surface 42 is an ear 48 which fit inbetween lugs 24–26, on flanges 22. Each ear contains a bore 50 for receiving a bolt 52. As the halves are interchangeable, only one bore is threaded.

The rear portion 54 of surface 42 is upturned to provide stiffness for the thin metal stock from which the clamp is made. The piece of metal connecting lip 46 to surface 42 also provides stiffness to the clamp.

Figure 2:
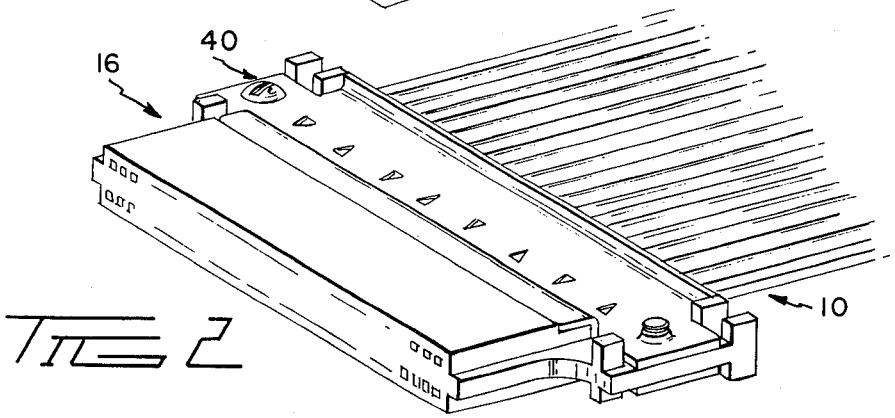
FIG. 2 shows the assembly of the components shown in FIG. 1.

FIG. 2 shows the assembled connector 56.

Figure 3:
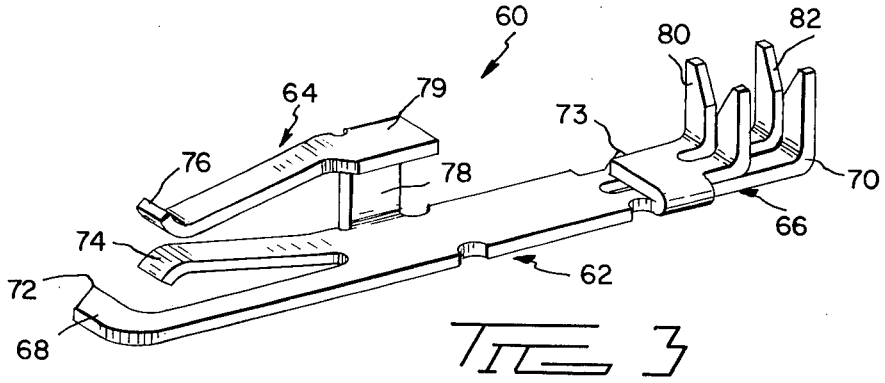
FIG. 3 is a perspective view of the contact member embodying features of the present invention.

Each of the aforementioned cavities 30 receive a contact member 60 which is illustrated in FIG. 3 and to which reference is now made.

Contact member 60 is formed from an integral piece of sheet metal, preferrably beryllium copper, and plated with gold or other suitable plating metals. Structurally the contact member may be divided into a base 62, an opposing cantilever contact spring section 64 and a terminating section 66, the former located near the front end 68 of the base and the latter positioned at the back end 70.

The front end 68 of the base 62 contains a laterally projecting sharp tip 72. Another similar tip 73 is provided on the same side of the base in the vicinity of terminating section 66.

Opposing cantilever contact spring section 64 include two arms 74–76 which slidingly engages a square post (not shown) such as are used to connect devices to printed circuit boards or other contact elements of other electrical circuits. The two arms are positioned on one side of base 62 with arm 76 directly overlying arm 74. Arm 76 is supported by a strap 78 which extends upwardly from the side of base 62 and a horizontal platform 79 which extends parallel to the base.

Each arm is bent to converge toward the other to provide in cooperation resilient engaging means with the afore-mentioned contact elements. The free ends of each arm diverge outwardly to facilitate post insertion.

Terminating section 66 includes two cantilever torsion bar L-shaped slotted terminals 80–82, the latter being immediately adjacent the back end 70 of contact member 60 and the former spaced forwardly thereof a preferred distance of about five times the thickness of the metal sheet. In the making of the contact member, terminal 80 is formed coplanar and parallel to terminal 82 and is then bent and wrapped over the top of base 62. The frist L-shaped terminal 80 is the primary contact terminal. The second L-shaped terminal 82 provides the strain relief for the wire being terminated therein and also is a secondary contact terminal. Each terminal consists of a horizontal part which parallels base 62 and a vertical part which extends upwardly from the horizontal part. The horizontal part is adapted to receive any twisting or torsional forces which may be applied to the contact member via cable 10. The vertical part is adapted to receive any vertical movement imparted thereto by the cable. The slots in each terminal begin in the top of the vertical part, such beginnings being beveled to facilitate wire receiving. As is well known in the art, such slots are dimensioned to the conductor or drain wire so that optimum electrical contact is achieved thereinbetween.

Figure 4:
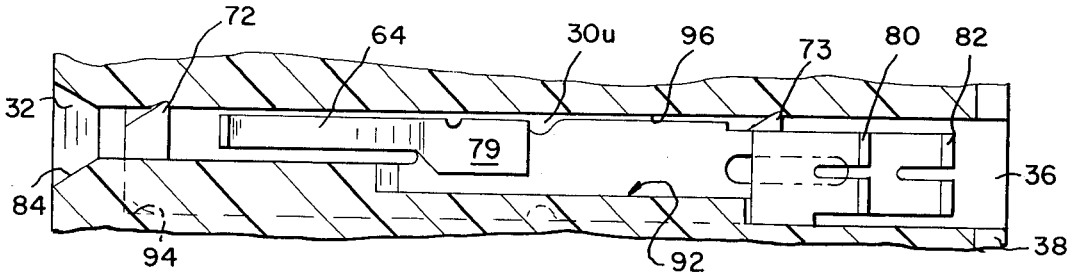
FIG. 4 is a plan view of one contact member of FIG. 3 positioned in one of the cavities of the housing member of FIG. 1.
Figure 5:
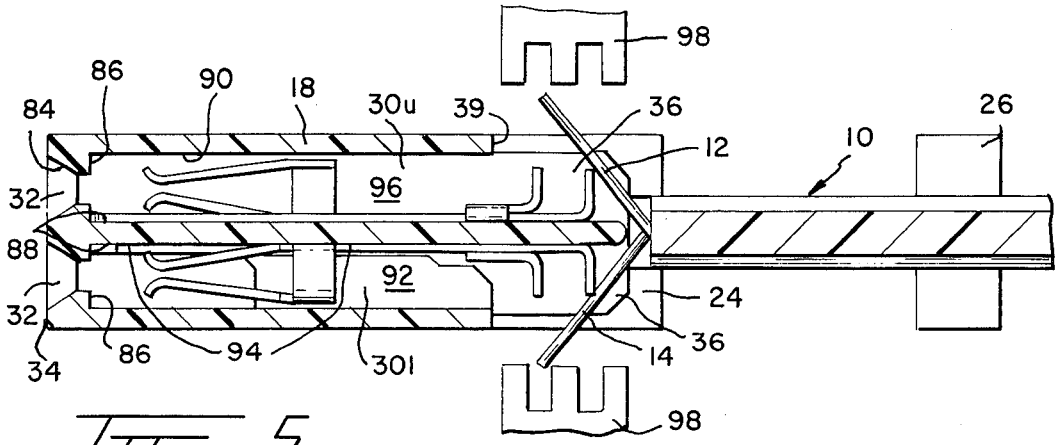
FIGS. 5 and 6 are side views of two contact members, positioned in the housing member, illustrating the method of terminating the coaxial ribbon cable of FIG. 1.

Returning to housing body 18 and more particularly to the cavities 30 which extend through the body, reference is now made to FIG. 4, a plan view of a cavity and FIG. 5, a cross-sectional view of the body taken along lines 5—5 of FIG. 1.

The cavities in the lower row, hereinafter designated as cavities **30*l*, are the mirror image of the cavities in the upper row, which cavities will be referred to as cavities 30*u*.**

Cavities 30 are designed to receive therein contact members 60 with the minimum amount of free space. Thus, since contact member 60 is not symmetrical, the cavities are not symmetrical. As FIG. 4 shows, entrances 32 have a inwardly beveled or funnel-shaped opening to facilitate the insertion of the square posts or other contact elements. As FIG. 5 shows, immediately past the opening, the height of the cavity increases as evidenced by rearwardly facing shoulders 86, one adjacent the cavity floor 88 and the other adjacent the cavity roof 90. The increased vertical dimension remains unchanged from shoulders 86 rearwardly.

The left side wall 92 of the cavities contains an undercut 94 adjacent to floor 88 to accommodate the base 62 of contact member 60. This undercut, only slightly larger than the thickness of the base, extends from the cavity entrance rearwardly to about the beginning of the contact opening 36.

The forward part of the cavity is wide enough to receive the contact spring section 66 which is on the right side of contact member 60.

The middle part of the cavity widens to receive the horizontal platform 79.

The rear part of the cavity, which is contact opening 36, is the widest part and accommodates the dual in-line terminals 80–82.

As FIG. 4 shows, the left side wall 92 is the wall which is progressively cut back to widen the cavities. As noted above, the lower cavities are the mirror image of the upper cavities. Thus, with the non-symetrical widening described above, while the entrances of the two rows of cavities are aligned, one below the other, the contact openings 36 of one row is displaced laterally from the other row. This displacement is equal to the distance between center conductor 12 and drain wire 14 of ribbon coaxial cable 10.

The right side wall 96 remains unchanged from entrance 32 to the end of contact opening 36.

Contact openings 36 are opened on the top to permit the insertion of a multi-anvil tool (FIG. 5) and to the rear so that the contact member 60 can be slid into the cavity during assembly.

In assembly the preferred embodiment, first, each of the cavities 30 is loaded with a contact member 60, those in cavities **30*u* facing in an opposite direction than those in cavities 30*l*. As FIG. 4 shows, any rearward pull on the contact members cause the tips 72–73 to dig into wall 96 and thusly the members are retained in the cavity. The shoulder 86 adjacent floor 88 provides a predetermined positioning means for the members 60** as well as a forward stop means.

Cable 10 is prepared by stripping the outer insulating jacket back to expose a suitable length of center conductor 12 and drain wire 14.

Figure 6:
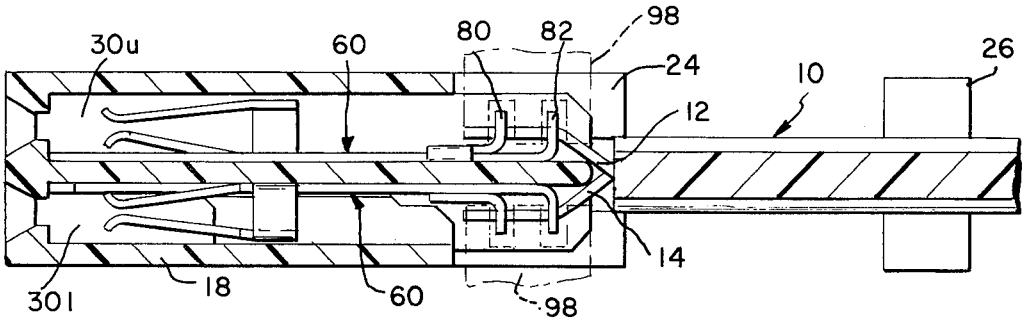

The exposed lengths of center conductor 12 are placed into contact openings 36 of cavities **30*u* in alignment with terminals 80–82 and the exposed lengths of drain wire 14 are placed into contact openings 36 of cavities 30*l*, also in alignment with terminals 80–82. Two multi-anvil tools 98 are brought into contact with the conductors and wires, pressing them into the slots in the terminals 80–82 as shown in FIG. 6. Thereafter, clamp halves 40** *a* and *b* are placed inbetween lugs 24–26 with lip 46 covering the top of contact openings 36. Upon bolting the halves together via bolts 52 the assembly is complete as shown in FIG. 2.

Figure 7:
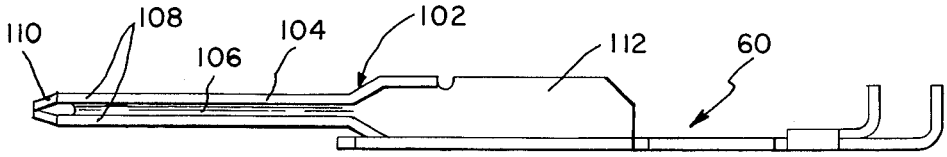
FIG. 7 shows another embodiment of the contact member of FIG. 3.

FIG. 7 illustrates a contact member 60′ wherein the contact spring section 64 of contact member 60 is replaced by a contact pin section 102. Section 102 includes a U-shaped pin 104 with the opening 106 of the U facing to the side. Legs 108 of the U are closed or pinched together at the free end 110 of the pin. The vertical strap 78 and platform 79 is replaced by a supporting wall 112. In all other respects contact member 60′ is the same as contact member 60. There are a number of uses for contact member 60′ including that of mating with contact member 60.

Of the several novel features of the housing and its cavities and of the contact member in its entirety, special note of the cantilever, torsion bar terminating section should be taken. Through the combination of two terminals, each being flexible in vertical-horizontal directions and in twisting motions, the contact member over-all has a very low vertical profile which enhances its use in miniaturization applications. Further, the novel features of the present invention provide a means whereby coaxial ribbon cable may now be terminated easily and with excellent electrical characteristics.

The foregoing detailed description has been given for clearness of understanding only, and no unnecessary limitations should be understood therefrom, as some modifications will be obvious to those skilled in the art.

What is claimed is:

1. A contact member stamped and formed from a coplanar sheet of conductive material, which comprises:

a. an elongated flat base having first and second ends;

b. means on the first end for engaging contact elements on other electrical circuits;

c. a first terminal formed at and from the second end of the base, said end being bent upwardly to provide a vertical portion, a wire-receiving slot extending through the vertical portion and into a portion of the adjacent horizontal base; and d. a second terminal having vertical and horizontal portions relative to the base, a wire-receiving slot extending through the vertical and into the horizontal portions, said second terminal being positioned inwardly from the first terminal and in overlying relation to the base and attached thereto by a section of material extending from the horizontal portion to a side of the base so that the second terminal may be moved independently from the first terminal and the base.

* * * * *